United States Patent [19]

Brentham

[11] 4,240,627

[45] Dec. 23, 1980

[54] MULTI-PURPOSE EXERCISING DEVICE

[76] Inventor: Jerry D. Brentham, P.O. Box #599, Belton, Tex. 76513

[21] Appl. No.: 962,067

[22] Filed: Nov. 20, 1978

Related U.S. Application Data

[63] Continuation-in-part of Ser. No. 790,051, Apr. 22, 1977, Pat. No. 4,185,818.

[51] Int. Cl.[3] ..... A63B 21/22

[52] U.S. Cl. ..... 272/130; 272/134; 272/143

[58] Field of Search ..... 272/72, 125, 130, 136, 272/135, 141, 143, 144, DIG. 1, DIG. 4, 134

[56] References Cited

U.S. PATENT DOCUMENTS

| | | | |
|---|---|---|---|
| 552,971 | 1/1896 | Sandow . | |
| 1,902,694 | 3/1933 | Edwards . | |
| 2,067,891 | 1/1937 | Comper . | |
| 3,120,954 | 2/1964 | Apostol . | |
| 3,174,343 | 3/1965 | Kasulis | 272/130 X |
| 3,465,592 | 9/1969 | Perrine . | |
| 3,471,145 | 10/1969 | Berger . | |
| 3,495,824 | 2/1970 | Cuinier . | |
| 3,702,188 | 11/1972 | Phillips et al. | 272/125 X |
| 3,756,595 | 9/1973 | Hague . | |
| 3,791,646 | 2/1974 | Marchignomi | 128/25 R X |
| 3,822,599 | 7/1974 | Brentham . | |
| 3,895,263 | 7/1975 | Mahlandt et al. | 128/25 R |
| 3,976,057 | 8/1976 | Barclay | 128/25 R |
| 4,022,463 | 5/1977 | Scott . | |
| 4,034,972 | 7/1977 | Peterson . | |

FOREIGN PATENT DOCUMENTS 1805628 5/1970 Fed. Rep. of Germany .

*Primary Examiner*—Richard C. Pinkham
*Assistant Examiner*—William R. Browne
*Attorney, Agent, or Firm*—Gerald G. Crutsinger; John F. Booth; Harry C. Post, III

[57] ABSTRACT

An arm and leg exercising device adapted to strengthen arm muscles and hip abduction and adduction muscles comprising body support members secured to a frame to support the human body such that the median axis of the human body is substantially parallel to the central axis of the body support members. A pair of padded leg support members, adapted to engage the side of the legs, and a member controlling the rate of movement are secured to the body support members to control movement of extremities of the leg support members in a lateral direction between a first position wherein the feet of a user are adjacent the median axis of the body of the user to a second position wherein the extremities of the leg support members are spaced from the median axis of the body. The body support members comprise a back portion, having an upper and lower end, and a seat portion, having an upper and lower end; the back and seat portions being positioned such that the lower ends of the back and seat portions are adjacent each other and such that the angle between upper surfaces of the back and seat portions are 90 degrees or greater, so as to support the legs in a slightly bent position. A pair of arm exercising members are pivotally secured to each side of the frame. Movement of each arm exercising member in a longitudinal direction relative to the central axis is independently resisted by a fluid flow resistance member.

10 Claims, 10 Drawing Figures

MULTI-PURPOSE EXERCISING DEVICE

CROSS-REFERENCE TO RELATED APPLICATIONS

This application is a continuation-in-part of my copending application Ser. No. 790,051, filed Apr. 22, 1977, now U.S. Pat. No. 4,185,818 entitled "Leg Exerciser."

BACKGROUND

Most exercising devices serve two purposes, to strengthen muscles and to rehabilitate muscles which have been damaged.

In contact and running sports, the knee is probably the most damaged portion of the body. It is important to strengthen the muscles in the hip, thigh and calf to prevent injury to muscles in these areas, and to assure proper rehabilitation of damaged muscles. Proper strengthening of these muscles in the hip, thigh and calf areas will prevent undue stress on the knee connecting tissue which is easily damaged. This is also true of the arm and back muscles which control the movements of the shoulders and elbow.

Heretofore, exercising devices have not utilized the full potential of stressing muscles throughout movement of a limb to fully strengthen adductor and abductor muscles of the hip. Strengthening the hip muscles and thigh muscles is extremely important in knee rehabilitation because any weak portion of the lower muscular system might result in reinjury of the previously damaged knee or other muscle.

For most efficient strengthening of these areas, it is necessary to isolate these muscles and restrain the rest of the body movement. In addition, it is important to position the body in an attitude similar to that in which the muscles will be doing their work. For example, most of the work done by muscles in the leg of an athlete is done while the leg is slightly bent at the knee and hip. Therefore, it is important to position the body such that the legs extend outwardly from the hip in a slightly bent position and the legs slightly bent at the knee to strengthen the muscles in the position that they are used.

Devices such as those disclosed in U.S. Pat. Nos. 3,120,954; 3,465,592; 3,495,824; and 3,822,599 generally use sophisticated hydraulic structures and pumps which add to the cost and complexity of the device and thereby reduce their availability to the general public.

Heretofore, devices which use weights have a fixed weight and as the limb, i.e. arm or leg, changes position the moment of force is changing and the force required to move the weight changes; therefore, the limb is not properly stressed throughout the range of movement. Further, the maximum force that the limb can exert generally increases as the limb moves from a bent position to a straightened position.

SUMMARY OF THE INVENTION

I have devised a multi-purpose leg and arm exercising device for strengthening the arm and back muscles and the hip abduction and adduction muscles along with the ham string muscles of the thigh. The device generally comprises a frame having a central axis with body support members on the frame adapted to support the human body in such a position that the median axis of the human body, an axis substantially parallel to the spine, is parallel to the central axis of the body support members. A pair of leg pads, comprising substantially U-shaped members having padding thereon, are connected to a means controlling the rate of movement of the outwardly extending leg support members. The pads are adapted to engage the side of the leg. Preferably, a thigh pad is positioned on the leg support members to engage the thigh just above the knee to resist lateral movement of the thigh, and an ankle pad is positioned on the leg support members to engage the side of the ankle to resist lateral movement of the ankle. Movement is controlled between a position wherein the thigh or ankle pad is adjacent the central axis of the body support members and a position spaced away from the central axis of the body support members in a generally horizontal or lateral direction.

A first pair of curl arms are pivotally secured to the rear lower portion of the frame and extend upwardly and forward on each side of the back support to provide an arm resistance in performing a curl. A fluid flow resistance cylinder to control the rate of movement is pivotally secured between the frame and each arm to resist movement of the arms.

A second pair of rowing arms are pivotally secured on each side of the seat support and extend upwardly and rearward to provide arm resistance in a rowing motion. A fluid flow resistance cylinder to control the rate of movement is pivotally secured between the frame and each arm to resist movement of the arms.

The body support members comprise a back portion and a seat portion, each having upper and lower ends. The lower ends of the back portion and the seat portion are positioned adjacent each other such that the angle between the upper surfaces of the back portion and seat portion is between 90 and 180 degrees such that the body is positioned with the legs slightly bent at the hip.

It is preferable that the thigh pad and ankle pad be positioned such that the leg will be in a slightly bent position such that the muscles of the hip and leg will be stressed when the leg is in the working position which is slightly bent at the knee.

By exerting pressure against the ankle pad by the leg of the user in attempting to move the ankle pad outwardly from the median axis of the body, the user stresses the medial and lateral ham string muscles in the leg. By applying pressure against the thigh pad in a lateral position to move the thigh pad outwardly from the median axis of the body, the user strengthens and stresses the adduction and abduction muscles in the hip.

A primary object of the invention is to provide an exercising device which isolates the leg and arm muscles to efficiently strengthen the muscles by controlling the rate of movement of the arm or leg throughout the range of movement.

Another object of the invention is to provide a combined arm and leg exercising device which efficiently exercises and strengthens back, arm and leg muscles which minimizes cost to the user and area required for set up of the device.

Another object of the invention is to stress medial and lateral ham string muscles by applying pressure against an ankle pad in a lateral direction to move the ankle relative to the median axis of the body.

A further object of the invention is to strengthen the abduction and adduction muscles of the hip by applying pressure with these muscles against one or more thigh pads, located just above the knee, and attempting to move the thigh pads away from the median axis of the body and back again while such movement is resisted.

A still further object of the invention is to position the body of a user in a position oriented similar to the position in which it would naturally be positioned to perform work.

Other and further objects of the invention will become apparent upon referring to the detailed description hereinafter following and to the drawings annexed hereto.

DESCRIPTION OF THE DRAWINGS

Drawings of a preferred embodiment of the invention have been annexed hereto, so that the invention will be more fully understood, in which.

Numeral references are employed to designate like parts throughout the various figures of the drawings.

DESCRIPTION OF A PREFERRED EMBODIMENT

Figure 3:
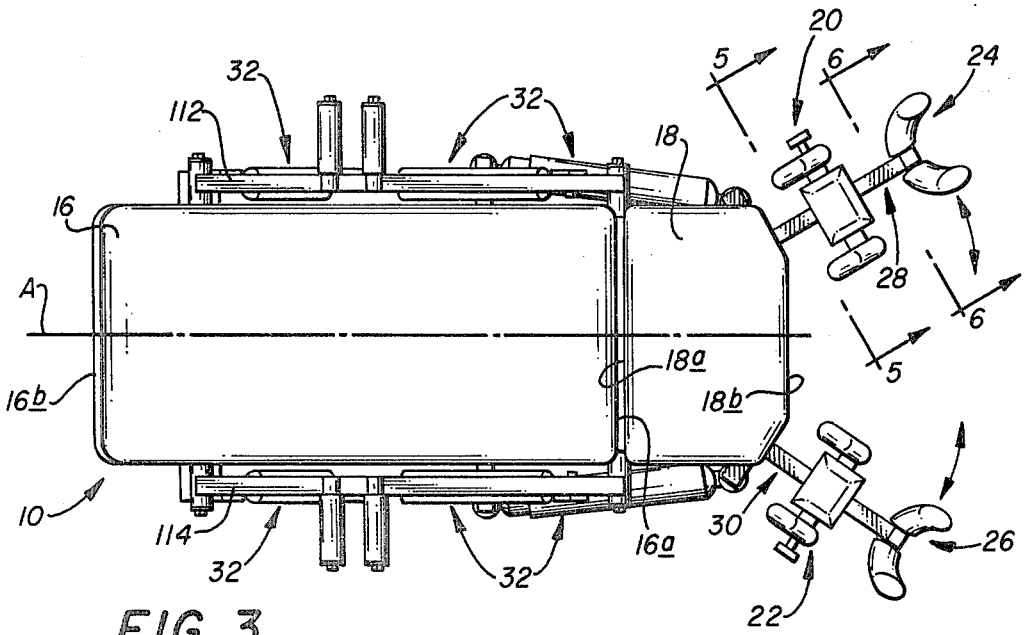
FIG. 3 is a reduced top plan view thereof.
Figure 4:
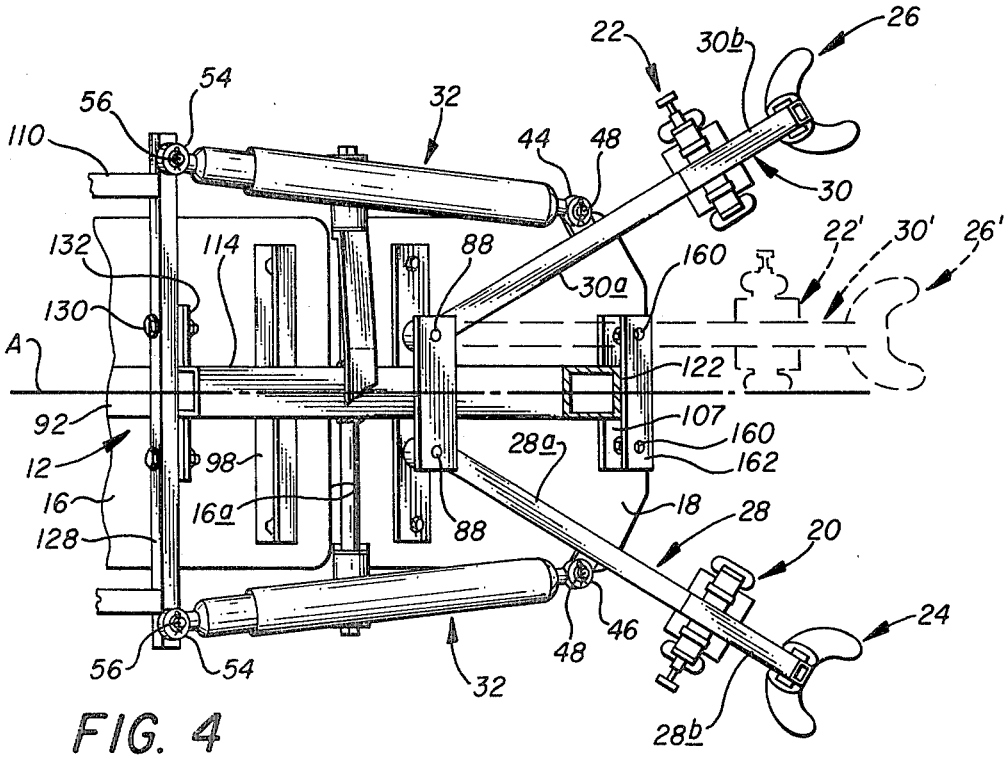
FIG. 4 is an enlarged bottom plan view of the leg support and fluid resistant cylinder with parts broken away to more clearly illustrate the details of construction.

An exercising device 10, adapted to strengthen the hip abduction and adduction muscles, generally comprises a frame 12 having a central axis A, as illustrated in FIGS. 3 and 4. Frame 12 has body support members 16 and 18 secured thereto to support the human body such that the median axis of the body, which generally passes through the body substantially parallel to the spinal column of the human body, is parallel to the central axis A of body support members 16 and 18 and frame 12.

A pair of leg pads 20 and 22 and ankle pads 24 and 26 are pivotally secured by connecting means such as leg support members 28 and 30 to the frame 12, as will be more fully explained hereinafter.

Means controlling the rate of movement, such as a fluid flow resistance member 32, is secured to leg support members 28 and 30 and the frame 12 such that the rate of movement of the leg pads 20 and 22 and leg support members is controlled from a position substantially parallel and adjacent to the central axis A of the frame 12, shown in dashed outline in FIG. 4, to a position wherein the extremities of the pads 22 and 20 and leg support members 28 and 30 are spaced from the median axis of the body and the central axis A of the frame 12.

Figure 8:
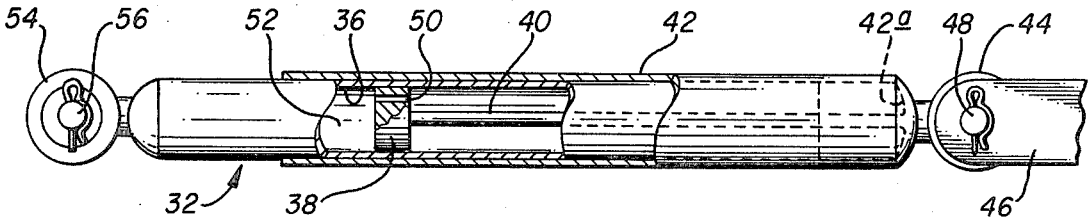
FIG. 8 is an enlarged cross-sectional view of the cylinder.

Means controlling the rate of movement of leg support members 28 and 30, such as fluid flow resistant member 32, is illustrated in FIG. 8 and generally comprises a two-way resistive cylinder such as standard motorcycle racing shock absorbers. The fluid flow resistant member 32 preferably comprises a cylinder 34 having a hollow bore 36 which defines a chamber 52 with a piston 38 slideably disposed therethrough. The piston 38 is connected to a connecting rod 40 which is secured to an inner end **42*a* of outer housing 42 which is slideably disposed over the exterior of cylinder 34. Housing 42 has a bushing 44 rigidly secured to the end thereof which is secured in clevis 46 by a pin 48 to one of the leg support members 28 and 30 and to the leg pads 20 and 22. Piston 38 has an orifice 50 for controlling the rate of flow of fluid from a first end of chamber 52 on one side of piston 38 to a second end of chamber 52 on the other side of piston 38. Fluid such as hydraulic oil, silicone or the like is placed in chamber 52 of cylinder 34 such that movement of the rod 40 and piston 38 is resisted by the rate of flow of fluid through the orifice 50. The end of cylinder 34 has a bushing 54 rigidly secured thereto which is secured to the frame 12 by pin 56**.

It should be readily apparent that cylinders 32 control the rate of movement throughout the range of movement of the limb and that the cylinders 32 exert a force substancially equal to the force applied thereagainst.

It should be readily apparent that movement of pads 20 and 22 is resisted from a position, shown in dashed outline as indicated by 22', substantially aligned with the central axis A of the frame to a position spaced from the central axis A of the frame 12. Fluid movement is controlled in both directions in chamber 52 such that movement of pads 20 and 22 and leg support members 28 and 30 is also controlled from the position spaced from the central axis A of the frame shown in full outline to the position substantially aligned with the central axis shown in dashed outline 22'.

Figure 5:
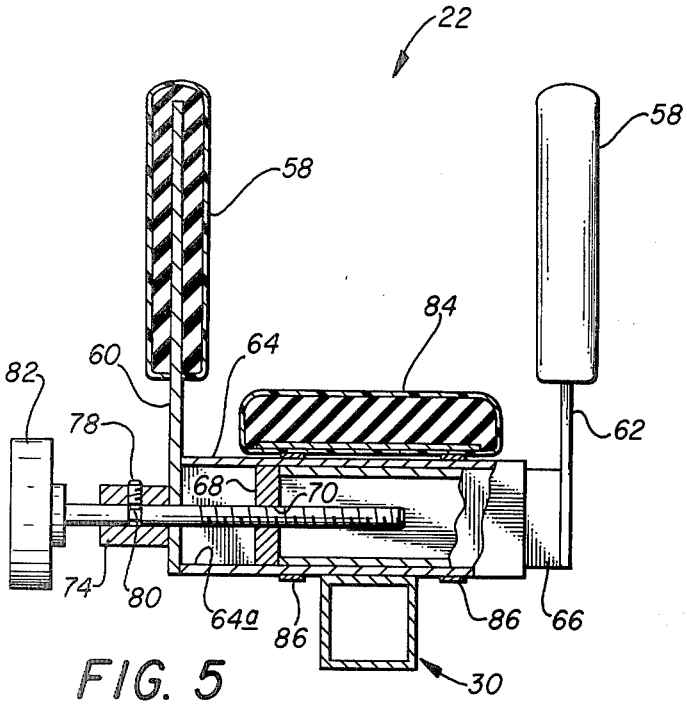
FIG. 5 is a cross-sectional view taken along line 5—5 of FIG. 3.

As best illustrated in FIG. 5, the leg pads 20 and 22 comprise generally U-shaped members having spaced vertically extending thigh pads 58 adapted to engage the thigh of the leg just above the knee. The spaced thigh pads 58 are supported by vertically extending arms 60 and 62. Means adjusting space between the thigh pad 58 comprises a substantially rectangular shaped tubular member 64 rigidly secured to vertically extending arm 60 and a substantially rectangular member 66 rigidly secured to vertically extending arm 62 having a smaller cross-sectional area such that it is slideably disposed within the bore **64*a* of member 64. An end plate 68 is rigidly secured to member 66 having a threaded passage 70 formed centrally therein. Means to move tubular member 66 and vertically extending arm 62 outwardly from arm 60 comprises a threaded screw 72 threadedly secured through passage 70 and rotatably disposed through a bushing 74 which is rigidly secured to the exterior of arms 60 such that the threaded screw 72 extends through passage 76 formed in the arm 60. A set screw 78 is threadedly secured to a passage formed in bushing 74 and engages a groove 80 formed in screw 72. A handle 82 is rigidly secured to end thereof for rotating screw 72**.

Transversely extending tubular member 64 is rigidly secured to leg support member 28 by welding or the like. A leg support cushion 84 is secured to tubular member 64 by straps 86.

Leg support members 28 and 30 generally comprise tubular members having a substantially rectangular cross-section, said members having a first end **28*a* and 30*a* pivotally secured by bolts 88 to the frame 12. As illustrated in the preferred embodiment, the second ends 28***b* and 30*b* of leg supports 28 and 30 are deflected downwardly such that the leg of the user is supported in a slightly bent position.

Figure 6:
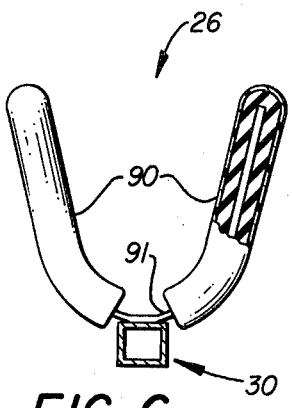
FIG. 6 is a cross-sectional view taken along line 6—6 of FIG. 3.

The ankle pads 24 and 26 are rigidly secured to the ends 28*b* and 30*b* of leg support members 28 and 30 and comprise substantially U-shaped members 91 having a cushion pad 90 (FIG. 6) positioned thereon adapted to receive force from the ankle the user.

From the foregoing it should be readily apparent that by exerting pressure at the knee of the user against the thigh pads 58 that the leg pads 20 and 22 will be moved outwardly from the position shown in dashed outline 22' to a position spaced from the central axis A of frame 12 shown in full outline 22 and such movement will be resisted by the fluid resistant members 32.

Figure 7:
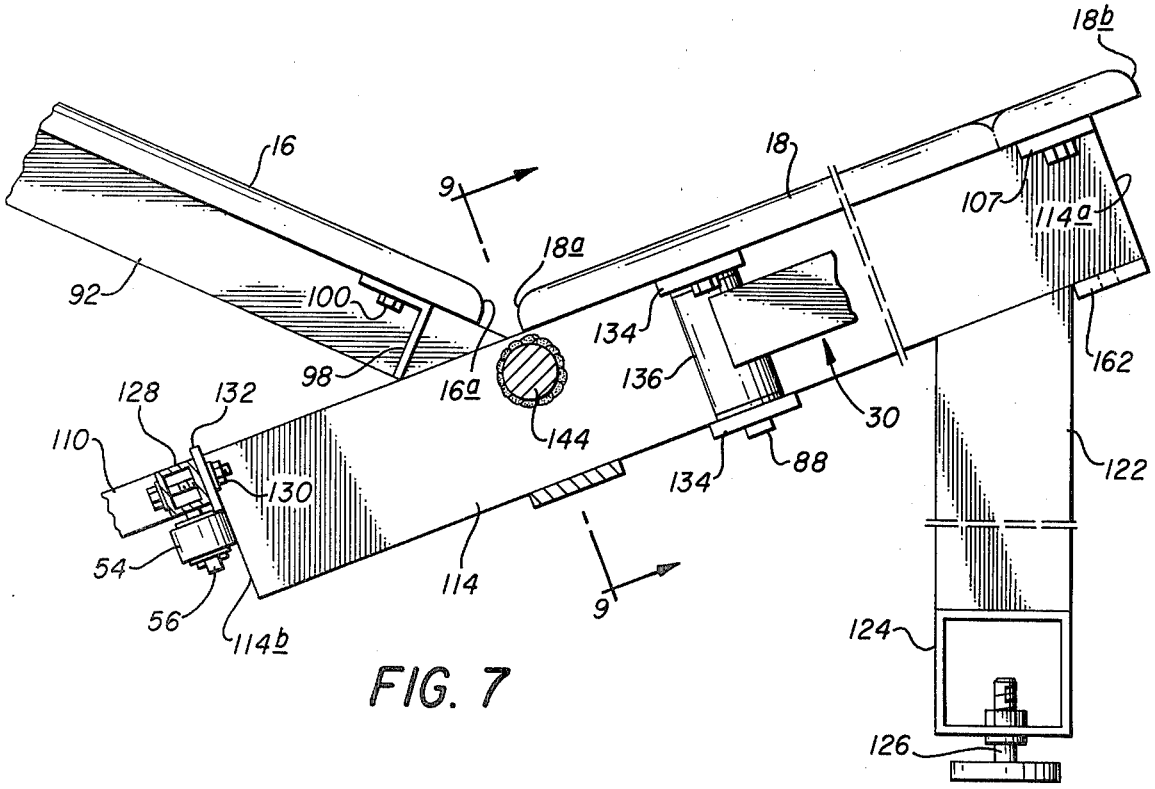
FIG. 7 is an enlarged side elevational view of the juncture of the back and seat portions.

Body support members 16 and 18 comprise substantially flat cushioned members each having lower ends 16*a* and 18*a* (FIG. 7) and upper ends 16*b* and 18*b*. The lower ends 16*a* and 18*a* of the body support members 16 and 18 are positioned adjacent one another such that the upper ends 16*b* and 18*b* extend outwardly from one another such that the angle between the upper surfaces of body support members 16 and 18 is substantially perpendicular or greater. This places the body in the reclining position with the legs in a slightly bent position which is substantially the same position that the user would be in when he is poised to work. It should be readily apparent that when the human body is positioned to do work, whether it be athletic or another type of physical endeavor, that the legs are in a slightly bent position to aid the back in lifting and the torso of the body is leaned slightly forward such that there is slight angle between the torso and the upper portion of the legs, commonly known as the thighs. Therefore, the angle between the upper surfaces of support members 16 and 18 is preferably an angle greater than 90 degrees and would be obtuse to support the body in this position and ends 28*b* and 30*b* are therefore deflected downwardly slightly to bend the knees. However, it should be readily apparent that other positions may accomplish the same results.

Figure 2:
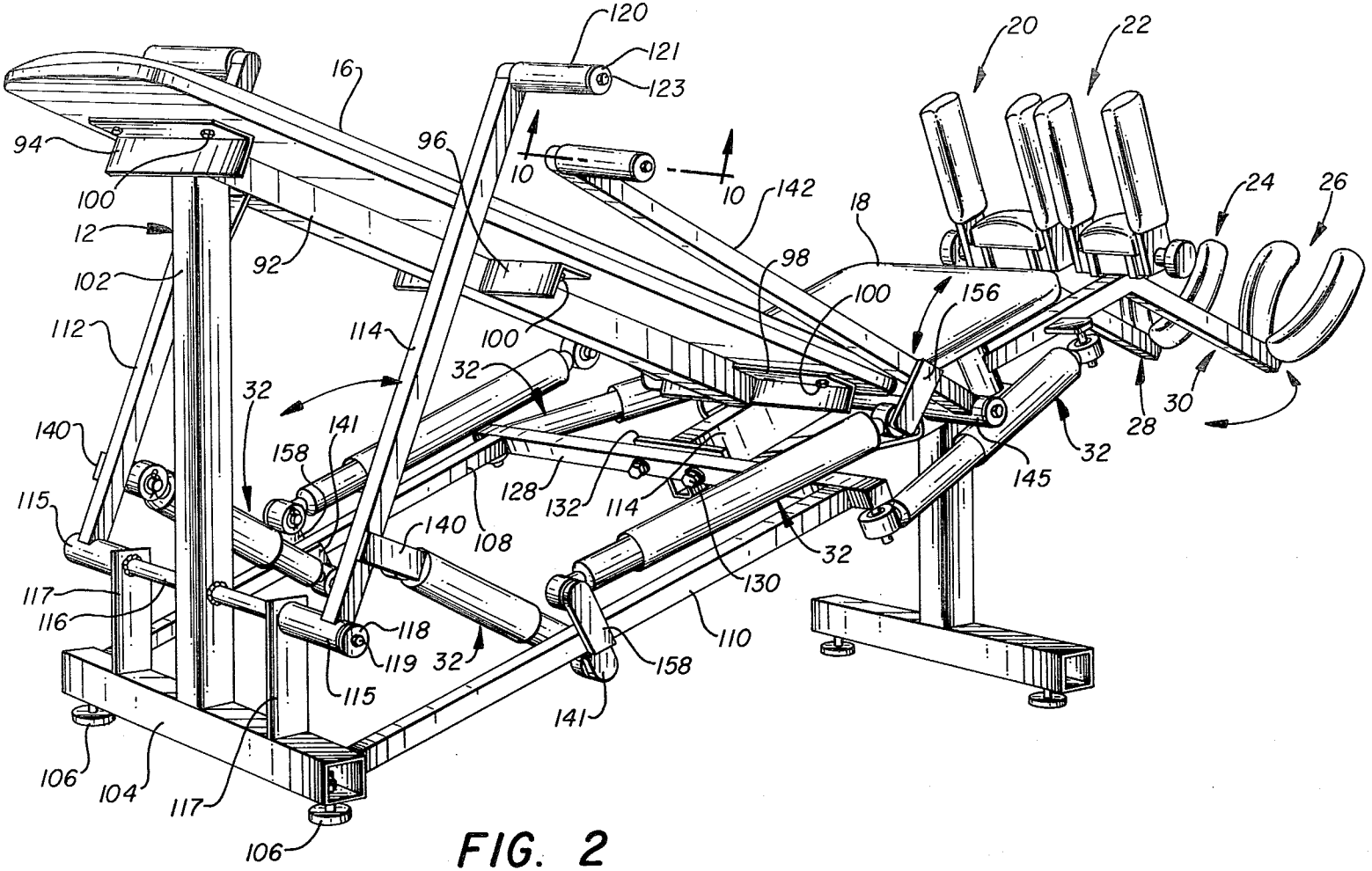
FIG. 2 is a rear elevational perspective view thereof.

The body support members 16 and 18, as best illustrated in FIG. 2, are supported by the frame 12 which is constructed of substantially rectangular shaped tubular steel. Frame 12 generally comprises an upper center member 92 substantially aligned along the central axis A of the frame 12. Spaced angles 94, 96, and 98 are welded or otherwise secured to center member 92 and secured to the body support member 16 by screws 100.

The upper end of center member 92 is connected to leg 102 which has a horizontal member 104 secured thereto for balancing the exercising device 10. Feet 106 are provided to prevent scarring of the floor and prevent skidding of the device. The lower end of center member 92 is welded or otherwise secured to the lower center member 114. End 114*a* of lower center member 114 is secured to leg 122 which is secured to a horizontal support member 124 having feet 126 secured thereto.

The other end 114*b* of lower center member 114 is secured to a transversely positioned cross bar 128 secured by bolts 130 to plate 132. The ends of cross bar 128 provide anchor means for the ends 54 of cylinders 34 through which pins 56 are secured. Spaced cross support members 134 are secured to the lower center member 114 and adapted to receive bushings 136 secured to the ends of leg support members 28 and 30 through which bolts 88 are secured to pivotally secure the end 28*a* and 30*a* of leg support members 28 and 30. Angle 107 is secured to end 114*a* of member 114 to support seat 18.

Longitudinal members 108 and 110 are secured on each side between horizontal member 104 and cross bar 128 for support of the arm cylinders to more fully explained hereinafter.

Figure 1:
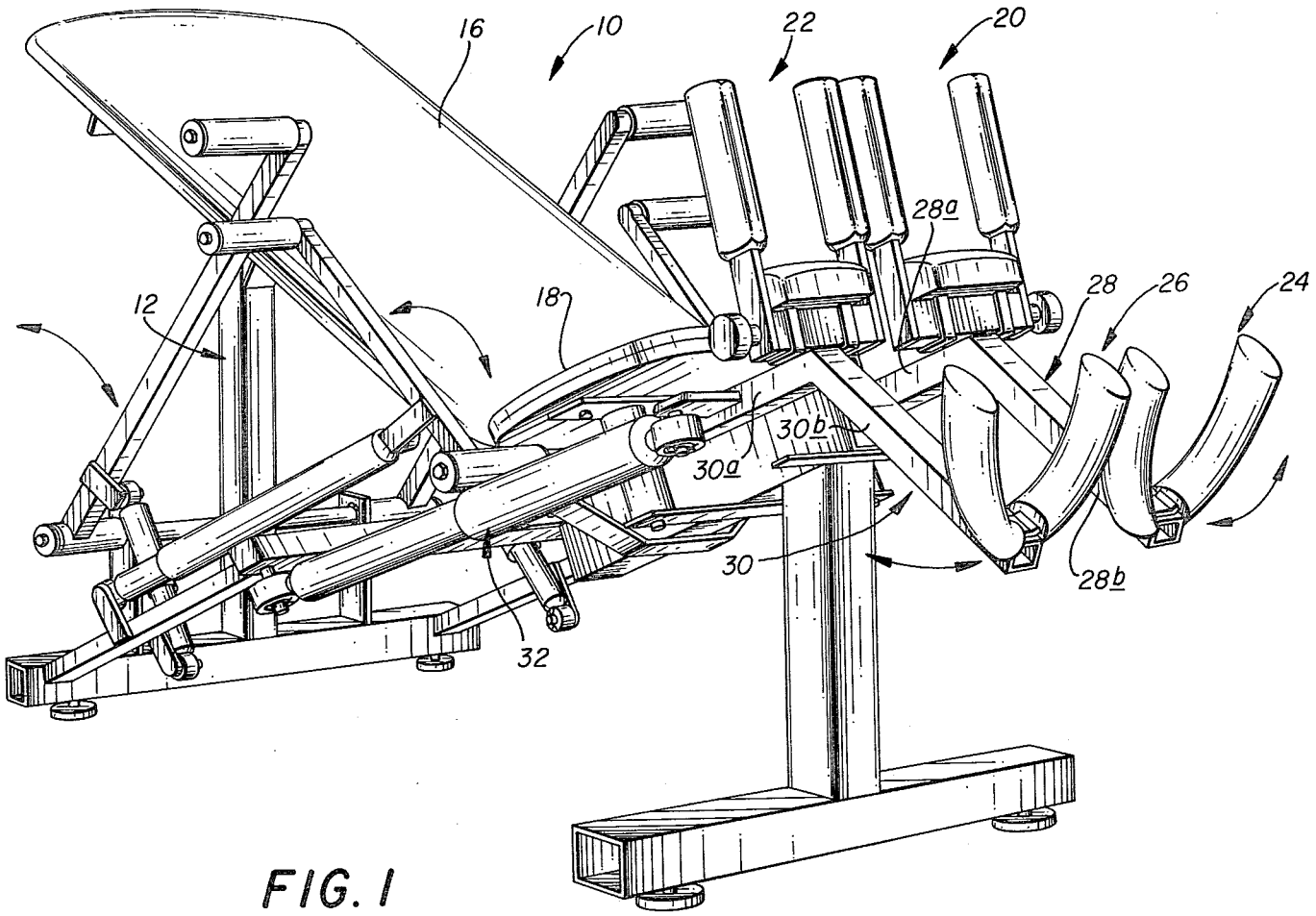
FIG. 1 is a front elevational perspective view of the leg exerciser.

Referring to FIGS. 1 and 2, a first set of curl arms 112 and 114 pivotally secured to the rear leg 102 and extend upwardly and forwardly. The ends of curl arms 112 and 114 are secured to bushings 115 which are pivotally secured on shaft 116. Shaft 116 extends through lug 117 secured to horizontal member 104 and through the lower portion of leg 102. A washer 118 is secured on each end of each bushings 115 and is secured thereto by a nut 119. The upper ends of arms 112 and 114 have a sleeve 120 rotatably secured on a shaft by washer 121 and nut 123 threadedly secured in the end of the shaft.

Means to control the rate of movement of arms 112 and 114 is pivotally secured between lugs 140 secured on the lower end of arms 112 and 114 and lugs 141 secured in the central portion of longitudinal members 108 and 110. The means controlling the rate of movement of arms 112 and 114 are cylinders 32 which work in a like manner to the cylinders 32 hereinbefore discribed.

Figure 9:
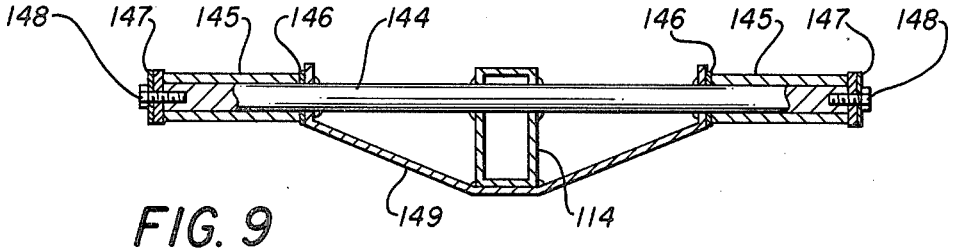
FIG. 9 is a cross-sectional view taken along line 9—9 of FIG. 7.
Figure 10:
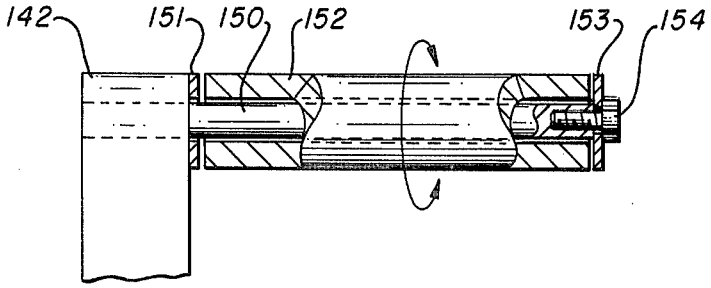
FIG. 10 is a cross-sectional view taken along line 10—10 of FIG. 2.

A second set of rowing arms 142 and 143 are pivotally secured to shaft 144 which extends outwardly from the juncture of back support 16 and seat support from lower central member 114. As illustrated in FIGS. 9 and 10, the lower ends of row arms 142 and 143 have bushings 145 pivotally secured between a washer 146 rigidly secured to shaft 144 and a washer on the outer end 147 secured by nut 148 in a threaded hole in the end of shaft 144. A U-shaped bracket 144 is welded to shaft 144 on each side adjacent washers 146 and under central support portion 114 to brace shaft 144. The upper ends of row arms 142 and 143 have a shaft 150 rigidly secured thereto and a washer 151 rotatably disposed on the inner edge to provide a bearing surface for sleeve 152 rotatably disposed about shaft 150. A second washer 153 is secured by bolt 154 to the end of shaft 150 such that the sleeve 152 rotates about shaft 150.

Means to control the rate of movement of arms 142 and 143 generally comprises a fluid flow resistance means 32 pivotally secured between lugs 156 on arms 142 and 143 and lugs 158 on the central portion of longitudinal members 108 and 110.

Operation of the hereinbefore described invention is as follows:

The user positions his body on the leg exercising device 10 such that his back rests against the upper body support member 16 and his hip rests on the lower body support member 18 with his legs extending outwardly through the leg support members 28 and 30. The user adjusts the width between the thigh pads 58 of leg pads 20 and 22 by turning knob 82 to firmly grip the thigh just above the knee.

In exercising the abduction and adduction muscles of the hip and upper leg, the user exerts pressure with his leg just above the knee against the thigh pads 58 of leg pads 20 and 22 on leg support members 28 and 30. The user continues to exert pressure against the thigh pads moving the leg pads 20 and 22 and leg support member 28 and 30 from a position shown in dashed outline 22' in FIG. 4 adjacent the central axis A of the frame 12 to a position outwardly therefrom shown in full outline. As this movement is resisted by the fluid flow resistant means 32, the muscles are stressed throughout the movement of the limb outwardly from the median axis of the body.

Movement of legs pads 20 and 22 is resisted from the position shown in full outline, in FIG. 4, spaced from the central axis A of the frame 12 of the position adjacent the central axis A of the frame 12 shown in dashed outline 22' such that the muscles which pull the leg inwardly are stressed throughout movement toward the median axis of the body.

By applying pressure against the ankle pads 24 and 26 with the ankle, the medial and lateral hamstring muscles are stressed such that they are strengthened.

In addition, the leg pads 20 and 22 may be locked into position by a pin (not shown) disposed through holes 160 in plate 162 and holes in legs 28 and 30 for performing isometric exercises on the legs.

It should be readily apparent that the device stresses the muscles of the legs throughout movement in a lateral direction from the median axis of the body which corresponds to the central axis A of the frame 12 to a position away from the central axis A and back again.

The first set of curl arms 112 and 114 allow the user to perform a curl type exercise when the user is seated in a sitting position to strengthen the arms. It should be readily apparent that since the movement is resisted throughout the range of moving the arm whereas when lifting weight in a curling position the most force is applied while the arms are outstretched and little force is applied in moving the weights horizontally while doing the curl at the upper portion of the stroke.

The second set of row arms 142 and 143 allow the user to perform a rowing exercise to strengthen the arms and back muscles. Again resistant to movement and the rate of movement is controlled by cylinders 32 throughout the range and the greater the force applied the greater the force with which the cylinders 32 resist movement. Therefore the muscles are stressed at maximum potential throughout the range of movement of arms 142 and 143 and arms 112 and 114.

It should be readily apparent that the user may lie on his stomach and perform a swimming motion by pressing forward on arms 112 and 114, if so desired. Further the user may reverse his body placing the arms in the leg support 28 and 30 and press with his feet on the arms 112 and 114 while exercising his arms laterally in the leg supports 28 and 30. Therefore a variety of positions and exercises may be performed wherein the muscles are stressed at maximum potential throughout the range of movement by the exercising device 10.

It should be appreciated that other devices tend to exercise in only a single direction and when using weight to apply force to devices the weight has only a downward force therefore in moving the weight horizontally through a range of movements the force is not as great as when moving vertically. It is preferred that a maximum force stress the muscles throughout the range of movement from the bent position to the extended position in order to maximize the potential of the exercise.

From the foregoing it should be readily apparent that the embodiment hereinbefore described accomplishes the objects of the invention hereinbefore discussed.

It should be appreciated that other and further embodiments of the invention may be devised without departing from the basic concept thereof.

Having described my invention, I claim:

1. An exercising device comprising: a frame having a central axis; body support means on said frame adapted to support a human body such that a median axis of the human body, the axis of the human body lying substantially parallel to the spine, lies parallel to the central axis of said frame; a leg exercising means on each respective side of the central axis pivotally secured to said frame for exercising the legs of the human body when the legs are moved in a lateral direction relative to the central axis; means for resisting movement of said leg exercising means pivotally secured between said frame and said leg exercising means; arm exercising means on each side of the central axis pivotally secured to said frame for exercising the arms of the human body when the arms are moved in a longitudinal direction relative to the central axis; and means for resisting movement of said arm exercising means pivotally secured between said arm exercising means and said frame to allow simultaneous movement of said leg exercising means and said arm exercising means.

2. An exercising device according to claim 1, wherein said leg exercising means comprises: a pair of leg support members extending outwardly from one end of said frame and pivotally secured to said frame such that ends of said leg support means which extend outwardly from the frame move in a generally horizontal direction relative to the central axis of said frame; a pair of leg pads secured to said leg support members; and wherein said means resisting movement of said leg exercising means resists movement of the leg pads in a generally horizontal direction relative to the central axis between a first position wherein the leg pads are adjacent said central axis of said frame and a second position wherein the leg pads are spaced from the central axis of said frame.

3. An exercising device according to claim 1, wherein said arm exercising means comprises: a first pair of exercise arms pivotally secured to a rear portion of said frame and extending upwardly and forwardly from the frame, said exercise arms being independently moveable against said means for resisting movement of said arm exercising means.

4. An exercising device according to claim 3, with the addition of: a second pair of exercise arms pivotally secured to said frame to extend upwardly on each side of the central axis and rearwardly from said frame for exercising the arms of the human body; and means for controlling movement of said second pair of exercise arms pivotally secured between said second pair of exercise arms and said frame to allow independent action of each exercise arm.

5. An exercising device according to claim 4, with the addition of: a sleeve rotatably secured to the upper end of each exercise arm of said first and second pairs of exercise arms to provide a handle for gripping during exercise.

6. An exercising device according to claim 1, wherein said body support means comprises: a back portion having an upper end and a lower end; a seat portion having an upper end and a lower end; means securing said back portion and said seat portion to said frame such that the lower end of said back portion is adjacent to the lower end of said seat portion with the angle between the upper surfaces of the back portion and the seat portion being obtuse.

7. An exercising device according to claim 1, wherein said means for resisting movement of each said leg exercising means and each said arm exercising means comprises: a cylinder having a chamber defined therein; a piston moveably disposed in said cylinder to divide the cylinder into two ends; means connecting the piston to a leg exercising means or an arm exercising means; and means for controlling the flow of fluid disposed in the chamber from one end of the chamber to the other end of the chamber to thereby control the rate of movement of the piston through the chamber.

8. An exercising device comprising: a frame having a central axis; body support means on said frame adapted to support a human body such that a median axis of the human body, the axis of the human body lying substantially parallel to the spine, lies parallel to the central axis of said frame; a pair of leg pads; a pair of ankle pads; means securing said leg and ankle pads to said frame for moving said pads laterally relative to said central axis in a generally horizontal direction; means for resisting movement of said securing means in the generally horizontal direction between a first position, wherein the leg pads are adjacent said central axis of the frame and a second position wherein said leg pads are spaced from said central axis of said frame; an exercise arm on each side of the central axis for exercising the arms of the human body pivotally secured to said frame and extending upwardly therefrom; and means for resisting movement of each exercise arm secured between said exercise arms and said frame.

9. An exercising device according to claim 8 wherein said exercise arms comprise: a pair of curl arms secured to each side of said frame; means for securing said pair of curl arms to the lower rear portion of said frame such that they extend upwardly and forwardly adjacent each side of the frame; a pair of row arms; and means securing said pair of row arms to said frame such that they extend upwardly and rearwardly and below said pair of curl arms.

10. An exercising device according to claim 8, wherein said means for resisting movement of said exercise arms comprises: a cylinder supporting a fluid having a chamber defined therein; a piston moveably disposed in said cylinder to divide the chamber into two ends; and an orifice extending through said piston for controlling fluid flow from one end of said chamber to the other end of said chamber which controls the movement of said piston through said chamber.

* * * * *